US009168440B1

(12) United States Patent
Dean

(10) Patent No.: US 9,168,440 B1
(45) Date of Patent: Oct. 27, 2015

(54) DIGITAL MEMORY GOLF GREEN REPAIR TOOL SYSTEMS

(71) Applicant: FINNdustries, LLC, Maricopa, AZ (US)

(72) Inventor: Paavola Dean, Maricopa, AZ (US)

( * ) Notice: Subject to any disclaimer, the term of this patent is extended or adjusted under 35 U.S.C. 154(b) by 0 days.

(21) Appl. No.: 14/534,165

(22) Filed: Nov. 5, 2014

Related U.S. Application Data

(63) Continuation-in-part of application No. 29/496,966, filed on Jul. 18, 2014.

(51) Int. Cl.
*A63B 57/00* (2015.01)
*H05K 5/02* (2006.01)

(52) U.S. Cl.
CPC ..... *A63B 57/0068* (2013.01); *A63B 57/0075* (2013.01); *H05K 5/023* (2013.01); *H05K 5/0217* (2013.01)

(58) Field of Classification Search
CPC ..... A63B 57/0068; A63B 57/0075; A63B 71/06; A63B 71/0669; H05K 5/0217
USPC ..... 473/408; 700/92
See application file for complete search history.

(56) References Cited

U.S. PATENT DOCUMENTS

| | | | | |
|---|---|---|---|---|
| D331,090 | S * | 11/1992 | Cellura | D21/793 |
| 5,160,134 | A | 11/1992 | McDonald | |
| 5,224,700 | A | 7/1993 | Rosen | |
| D353,110 | S * | 12/1994 | Calabrese et al. | D10/46.1 |
| 5,409,212 | A * | 4/1995 | Arnett | 473/404 |
| 5,449,169 | A | 9/1995 | Hardin et al. | |
| 5,728,006 | A * | 3/1998 | Teitell et al. | 473/151 |
| D418,067 | S * | 12/1999 | Bezas | D10/46.1 |
| 6,513,165 | B1 * | 2/2003 | England et al. | 2/161.2 |
| 6,837,807 | B1 | 1/2005 | Kerr | |
| 7,207,902 | B1 * | 4/2007 | Hamlin | 473/353 |
| D669,148 | S * | 10/2012 | Dalton | D21/793 |
| D674,715 | S * | 1/2013 | Dalton | D10/70 |
| 8,348,787 | B2 | 1/2013 | Halsey et al. | |
| 2002/0034993 | A1 | 3/2002 | Mincher | |
| 2006/0068944 | A1 * | 3/2006 | Sandberg | 473/408 |
| 2007/0026369 | A1 * | 2/2007 | Smith et al. | 434/252 |
| 2008/0108456 | A1 * | 5/2008 | Bonito | 473/409 |
| 2009/0119821 | A1 * | 5/2009 | Stillwell | 2/312 |
| 2009/0298605 | A1 * | 12/2009 | Wiegers | 473/199 |
| 2009/0303204 | A1 * | 12/2009 | Nasiri et al. | 345/184 |

(Continued)

FOREIGN PATENT DOCUMENTS

DE 202013004055 6/2013

OTHER PUBLICATIONS

"USB Flash MP3 Drive", www.promokeychain.com, Apr. 2, 2013.*

(Continued)

*Primary Examiner* — Michael Cuff
(74) *Attorney, Agent, or Firm* — Bycer Law, PLC; Matthew L. Bycer

(57) ABSTRACT

An apparatus is provided which is capable of repairing a golf green as well as concealing a detachable electronic component, providing digital audio and LCD display screen components, and having a GPS chip and RFID device, in multiple embodiments of the present invention. The electronic component comprises a port which is a USB-compatible device, and may also be connected to a flash memory device to allow a user to save data files captured by the memory device and upload to any device with a USB port.

19 Claims, 14 Drawing Sheets

(56) References Cited

U.S. PATENT DOCUMENTS

| | | | | |
|---|---|---|---|---|
| 2010/0137077 | A1* | 6/2010 | Petela | 473/406 |
| 2010/0311522 | A1* | 12/2010 | Balardeta et al. | 473/407 |
| 2010/0311523 | A1* | 12/2010 | Balardeta et al. | 473/407 |
| 2012/0116714 | A1* | 5/2012 | Rogel et al. | 702/150 |
| 2012/0190386 | A1* | 7/2012 | Anderson | 455/456.3 |
| 2012/0296455 | A1* | 11/2012 | Ohnemus et al. | 700/91 |
| 2013/0065710 | A1 | 3/2013 | Schaaf | |
| 2013/0095958 | A1* | 4/2013 | Solheim et al. | 473/406 |
| 2014/0009335 | A1* | 1/2014 | Park | 342/357.57 |
| 2014/0106311 | A1* | 4/2014 | Skrepetos | 434/16 |
| 2014/0258850 | A1* | 9/2014 | Carey | 715/243 |
| 2015/0039394 | A1* | 2/2015 | Bonito | 705/7.33 |

OTHER PUBLICATIONS

"Custom USB Flash Drive—Golf Ball", www.promokeychain.com, Jan. 23, 2012.*

"golf Scorer Tool", www.anypromo.com, May 30, 2013.*

"Custom Shapeflash", www.pesagontech.com, Oct. 28, 2012.*

"Swiss Army Style USB Flash Drive", www.logotech.com, Dec. 12, 2012.*

* cited by examiner

DIGITAL MEMORY GOLF GREEN REPAIR TOOL SYSTEMS

The present application is related to and claims priority to Design Patent Application No. 29/496,966, filed Jul. 8, 2014 which application is incorporated herein by reference.

FIELD OF THE INVENTION

The present invention relates generally to the field of electronic tool accessories and more specifically relates to a golf green repair tool having integrated electronic and digital components for providing multifunctional use.

DESCRIPTION OF THE RELATED ART

In golf, maintaining the condition of a golf course is of prime concern, especially with the increased amount of play due to the growing popularity of the sport. One of the most important areas of the golf course is the putting green which must be maintained in near perfect condition so that the golf ball rolls true along the putting surface. Unfortunately the putting green is often damaged by foot traffic and ball impact damage.

In playing the game, the short range shot which comes to rest on the putting green is traditionally referred to as a pitch shot. As a result of the pitch shot, the golf ball often impacts the putting green with significant velocity, thereby creating an indentation. The indentation is traditionally referred to as a pitch mark, or commonly a divot. As a courtesy to those playing with or behind the player whose shot made the pitch mark, it is customary for that player to repair the divot using a handheld tool specifically designed to repair damage to golf course putting greens, the handheld device is traditionally referred to as a pitchfork. In order to maintain the condition of the course, players are urged to repair all divots that they notice or create during a round of play. Particular attention is urged with regard to the putting surface of the greens due to the sensitive nature of their effect upon a player's score. An immediate repair facilitates the natural recovery of the grass system which would otherwise dry out, preventing the grass root system from re-growing.

In order to facilitate the repair of putting green divots, various tools have been devised for golfers to carry and use. Divot repair tools are typically fork-shaped implements having tines that are pressed into the playing surface which can then be lifted or otherwise manipulated to restore its condition.

As is known, the game of golf has become a popular pastime for a great number of people. The popularity of the game has created opportunities for companies and charitable organizations, both public and private; to advertise their products, capabilities or cause. The organizations advertise and invite guests to a golf course for the purposes of social interaction and networking in the hopes of developing a business relationship or obtaining donations. The events, commonly known as "Golf Outings", are where corporate sponsors customarily provide golf themed accessories with a specific logo or corporate insignia being prominently displayed thereon. Frequently corporate sponsors are interested in distributing electronic media (brochures, links to their internet site, other visual media) at these outings. This advertising information has routinely been provided on "thumb drives" or USB flash memory sticks that have become ubiquitous due to their versatility and usefulness in the modern digital age.

Ideally, a golf green repair accessory should provide a digital memory for storage and ample room for advertising, and, yet would operate reliably and be manufactured at a modest expense. Thus, a need exists for a reliable digital memory golf green repair tool to avoid the above-mentioned problems.

BRIEF SUMMARY OF THE INVENTION

In view of the foregoing disadvantages inherent in the known digital golf green repair tool art, the present invention combines the usefulness of the divot or putting green repair tool (pitchfork) and digital, preferably electronic flash memory into a single device.

The general purpose of the present invention, which will be described subsequently in greater detail, is to provide a multifunctional golf divot repair tool having an optional electronic component and a digital memory component for providing a versatile, handy, and conveniently accessible golf accessory for use when golfing.

The present invention further creates an opportunity for sponsors of a golf outing to offer a functional golf themed accessory that the recipient may use during the outing, as well as, on the go, at the home, or office. The present invention may incorporate both visual and electronic media onto a single device, thereby increasing the exposure to the strategically placed logo(s) and electronic corporate media that may have been stored onto the device memory.

A multifunctional digital memory golf green repair tool system is disclosed in a preferred embodiment comprising a divot tool body which may comprise a handle, a belt clip, at least one, but preferably at least two tines coupled to the bottom of the divot tool body, an electronic component integrated into the body, and to port coupled to the divot tool body and coupled to the electronic component providing access to the electronic architecture therein.

The divot tool body handle may have a top end, a bottom end, a right side, a left side, a front, and a back. The handle front may comprise a thumb-sized hollow indentation for ease in handling and manipulation of the divot tool body. Preferably, the port comprises a USB-compatible device.

In an alternative embodiment of the present invention, the electronic component may comprise a digital golf stroke counter assembly. The digital golf stroke counter assembly may comprise a display screen, a microprocessor, a plurality of control buttons, and at least one power source for powering the digital golf stroke counter assembly. The counter-microprocessor may be in communication with the control buttons and display screen, and the counter-microprocessor of the digital golf stroke counter assembly may be able to write a data file to the flash memory device. The digital golf stroke counter assembly may be structured and arranged to enable a golfer to track golf strokes while playing a hole of golf. The electronic component may further comprise a GPS chip for tracking a relative location of the golf green repair tool to at least one golf-course-related point of interest.

Furthermore, the electronic component may comprise a radio-frequency identification (RFID) device. The RFID device may be structured and arranged to transmit and receive radio-frequency identification between the GPS chip and/or at least one golf-course-related point of interest. RFID may also be used without GPS, for instance, the RFID antenna may be pinged by an outside source (preferably a fixed golf location with audio capabilities) to activate an audio message, i.e. advertisement or information, at a specific location on the course, thereby creating an interactive golf experience.

The electronic component may further comprise an audio component. The audio component may comprise at least one micro-speaker located on the divot tool body. The audio component may be structured and arranged to play at least one audio file stored on the flash memory device.

It should be appreciated that during a round of golf, the digital memory golf green repair tool system may be useful for repairing divots on the golf course while providing a golfer with multifunctional tools useful during play.

The present invention holds significant improvements and serves as a digital memory golf green repair tool system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, digital memory golf green repair tool systems, constructed and operative according to the teachings of the present invention.

The various embodiments of the present invention will hereinafter be described in conjunction with the appended drawings, wherein like designations denote like elements.

DETAILED DESCRIPTION

Figure 1:
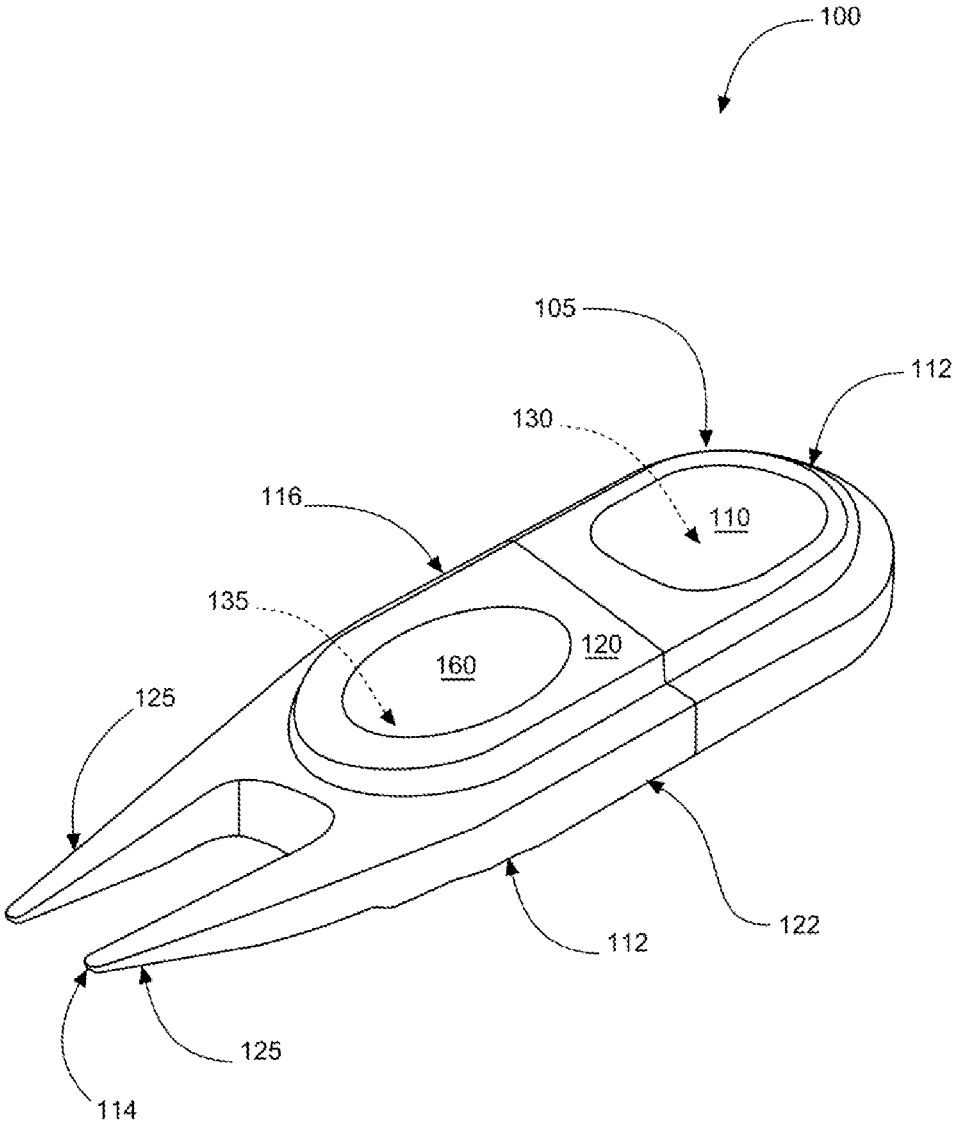
FIG. 1 shows a perspective view illustrating a digital memory golf green repair tool system in a closed-position. The digital memory golf green repair tool system is shown comprising a divot tool body having a handle for handling the divot tool body according to an embodiment of the present invention.

As discussed above, embodiments of the present invention relate to a golf green repair tool and more particularly to a digital memory golf green repair tool which combines the usefulness of a divot or putting green repair tool and an integrated digital electronic flash memory into a single device. Alternatively, other sorts of small portable, low/no energy digital storage will suffice to practice the invention, including but not limited to secure digital (SD), solid-state drive (SSD), etc.

Generally speaking, a digital memory golf green repair tool system comprises a divot tool body comprising a handle. The handle may comprise a top end, bottom end, a right side, left side, front, and back. Directions of the ends (i.e. top, bottom, side, etc.) serve only to provide the relative position of each side, and in no way are to be understood to direct the appropriate use of the invention. At least one, but preferably at least two tines may be coupled to the bottom of the divot tool body. The divot tool body may comprise a hollow cavity for securely retaining an electronic component integrated into the divot tool body. A port may be coupled to the divot tool body and coupled to the electronic component thereby providing access to the electronic component. The divot tool body is useful for raising a divot in a golf green for leveling the golf green surface and also providing a user with digital memory storage via the electronic component accessible via the port. Preferably, the port comprises a USB-compatible device.

As shown, the divot tool body may comprise thumb-sized hollow indentation on the handle front. The thumb-sized hollow indentation may enable the user to ergonomically grip the handle and apply force with a thumb of a hand of the user when inserting the two tines into the golf green surface.

Further, the thumb-sized hollow indentation on the handle front may assist the user in detaching and attaching a top element from a bottom element in an alternative embodiment of the present invention described herein.

In one embodiment of the present invention, the divot tool body may comprise a ball marker coupled to the handle front. The ball marker is useful for marking a location of a golf ball on a putting green when another player is putting. Furthermore, the ball marker may comprise a magnetic component for mating with a complementary magnetic component housed within the divot tool body. Alternatively a metallic ball marker may correspond to complimentary magnetic component, both including magnets, or other means of including attachment, including mechanical means such as boss and indentation/aperture, etc. The magnetic component is useful for enabling the user to magnetically attach and detach the ball marker to the divot tool body.

In one embodiment of the present invention, the divot tool body may comprise at least two separable elements, a top element and a bottom element. The top element may comprise the electronic component, the port, and a male mating coupler. The bottom element may comprise a female mating coupler for mounting the top element with the bottom element so as to join separable elements into the divot tool body.

In an alternative embodiment, the bottom element comprises the electronic component, the port, and a male mating coupler such that the top element comprises a female mating coupler for mounting the top element with the bottom element so as to join separable elements into the divot tool body.

In one embodiment of the golf green repair tool, the electronic component may comprise a flash memory device. The electronic component may further comprise a digital golf stroke counter assembly. The digital golf stroke counter assembly may comprise a display screen, a microprocessor, a plurality of control buttons, and at least one power source for powering the digital golf stroke counter assembly. The counter-microprocessor is in communication with the plurality of control buttons and the display screen. It should be appreciated that the digital golf stroke counter assembly is structured and arranged to enable at least one golfer to track golf strokes while playing at least one hole of golf.

Preferably, the display screen comprises a LCD, backlight LED or other display screen. Alternatively, the display screen may comprise a touch screen. During use, the digital golf stroke counter assembly is structured and arranged to be able to write a data file to the flash memory device. The data file may be displayable on the display screen, and stored for later use by the user.

The plurality of control buttons may be useful for controlling the digital stroke counter assembly. At least one of the control buttons comprises a button for counting a stroke on at least one hole of golf. At least one of the control buttons comprises a button for advancing to a new hole of golf and resetting the counter to 0. At least one of the control buttons may comprise a power button for powering on and off the digital stroke counter assembly. At least one of the control buttons may comprise an "execute" button for executing at least one command of the digital stroke counter assembly. Commands may include, but are not limited to, storing data files to the flash drive of the electronic component, deleting data files from the flash drive of the electronic component, re-writing data files, loading at least one data file, playing an audio data file, stopping an audio data file, advancing through data files, and the like.

In another embodiment of the present invention, the electronic component may comprise a GPS chip for tracking a relative location of the golf green repair tool to at least one golf-course-related point of interest. The divot tool body may comprise a GPS switch located for enabling the golfer to selectively activate or deactivate the GPS chip. GPS-related data may provide a user with information about relative location on the course, including hole information, distance from the pin, etc. Data on the course, such as hole, and pin information may be stored on board, i.e. on the flash memory component.

Furthermore, the electronic component may comprise a RFID device. The RFID device may be structured and arranged to transmit and receive radio-frequency identification between the tool and a one golf-course-related point of interest. The GPS chip and the RFID device may be powered by the power source powering the digital golf stroke counter assembly. Examples of golf-course-related points of interest include, but are not limited to, golf pin location for each golf hole, clubhouse location, golf hole tee location for different player levels, bathroom location, restaurant or cafe location, and the like.

During use, the GPS device may be synced with a transmitter or transceiver device having GPS capability located at least one golf-course-related point of interest. In such a manner, the golf green repair tool is able to detect a maximum measurable distance between the divot tool body and the at least one golf-course-related point of interest. It should be appreciated that the golfer-user is able to toggle through various golf-course-related points of interest and select a particular golf-course-related point of interest via the plurality of control buttons and the distance may be displayed on the display screen of the digital golf stroke counter assembly. In such a manner, the golfer is able to determine a distance from his or her golf ball to the golf pin at any point in time during a round of golf.

During use, the onboard RFID may encompass either an on hoard antenna or emitter. In this embodiment, various locations on the course can be hard-wired to emit RFID. When the tool is passed by, the antenna reflects the signal and triggers the emitter, for instance, to provide audio information or advertisement. It can also alert the presence, timing and other information to the course management. In an alternative embodiment, an RF emitter may be powered and on-board the tool. In this embodiment, various antenna reflectors are positioned throughout the course to trigger varied pre-determined signals to the player, i.e. course information, advertisements and other location related information.

In another embodiment of the present invention, the electronic component may comprise an audio component. The audio component may comprise at least one micro-speaker located on the divot tool body. The audio component is able to play at least one audio data file, i.e. music file, storable on the flash drive of the golf green repair tool via the micro-speaker. Further, the audio component is able to read aloud golf scores, measured distances via the GPS chip, and other golf course related information.

In another embodiment of the digital memory golf green repair tool system, the divot tool body may further comprise a belt clip. The belt clip may be useful for attaching the digital memory golf green repair tool system to a belt or garter loop of the golfer. In such a manner, the golfer may be able to freely swing his or her golf club such that the digital memory golf green repair tool system does not interfere with his or her swing.

Referring to the drawings by numerals of reference there is shown in FIG. 1, a perspective view illustrating digital memory golf green repair tool systems 100 in a stored-position according to an embodiment of the present invention. As shown, digital memory golf green repair tool systems 100 may generally comprise divot tool body 105 having handle 110 for handling divot tool body 105. As shown in FIG. 1, handle 110 of divot tool body 105 comprises top end 112, bottom end 114, right side 116, left side 118, front 120, and back 122. It should be appreciated that handle 110 may enable golfer 140 to handle divot tool body 105 in such a manner to be used as a divot repair tool for evening out a golfing surface (ie. smoothing divots on a putting green surface caused by approach shots).

Figure 2:
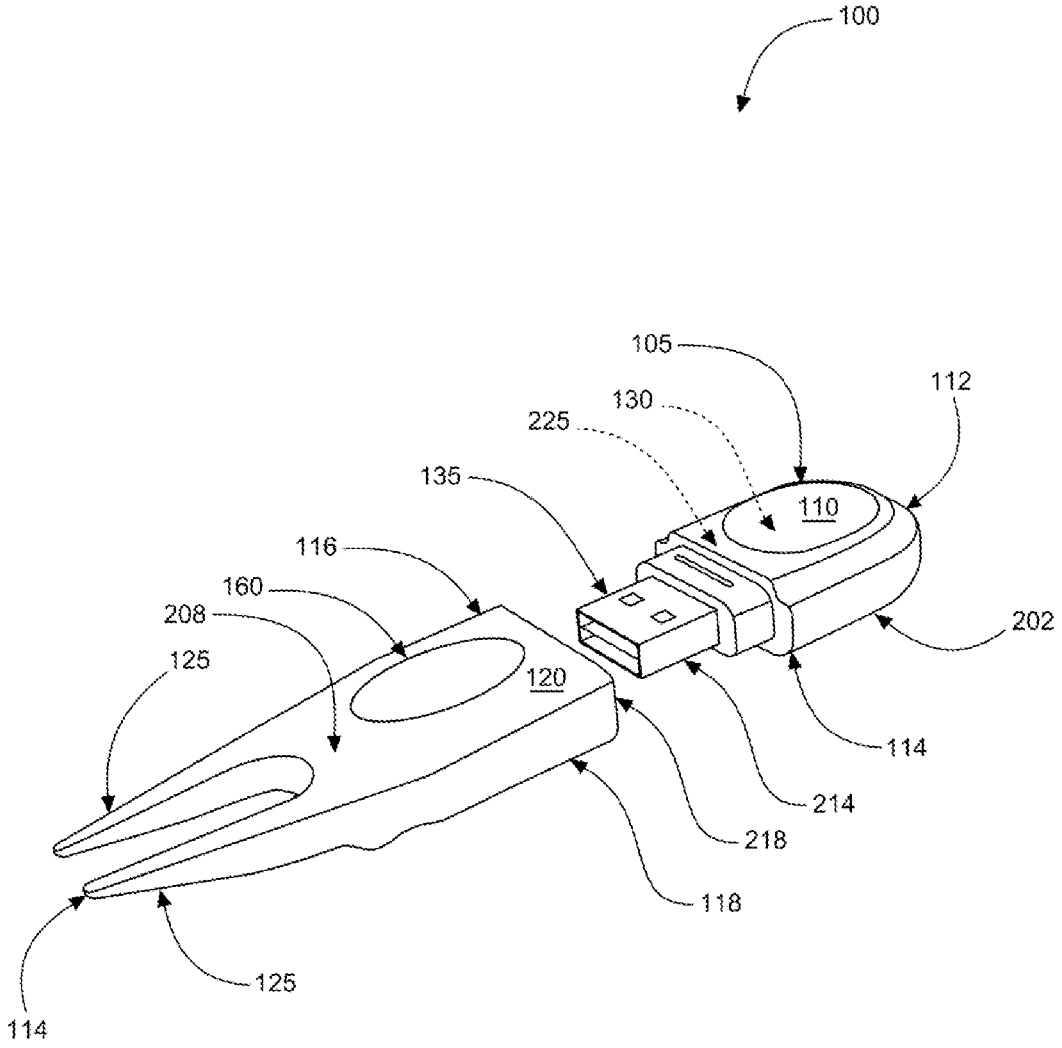
FIG. 2 is a perspective view illustrating the digital memory golf green repair tool system in an open-position showing the divot tool body in two separable parts comprising a top element and a bottom element according to an embodiment of the present invention of FIG. 1.
Figure 3:
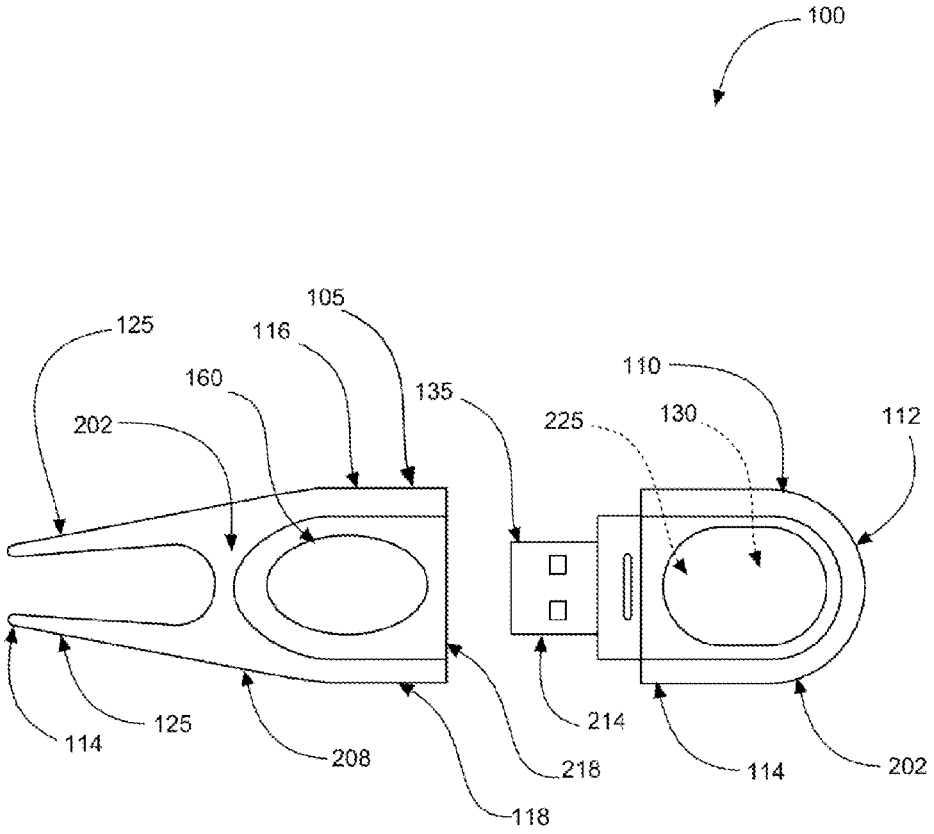
FIG. 3 is a top perspective view illustrating the divot tool body in two separable parts according to an embodiment of the present invention of FIGS. 1 and 2.

Referring now to FIGS. 2 and 3 showing perspective views illustrating digital memory golf green repair tool systems 100 in an open-position showing divot tool body 105 in two separable parts comprising top element 202 and bottom element 208 according to an embodiment of the present invention of FIG. 1. Digital memory golf green repair tool systems 100 may comprise divot tool body 105 comprising handle 110, two tines 125 coupled to bottom of divot tool body 105, electronic component 130 integrated into divot tool body 105 and port 135 coupled to divot tool body 105 and coupled to electronic component 130 for providing access to electronic component 130.

In referring to FIG. 3, a top perspective view is shown of divot tool body 105 having two separable elements; top element 202 and bottom element 208. In one embodiment of the present invention, top element 202 may comprise electronic component 130, port 135, and male mating coupler 214. Bottom element 208 may comprise female mating coupler 218 for mounting top element 202 with bottom element 208 so as to join the separated elements into divot tool body 105.

In another embodiment of the present invention, bottom element 208 may comprise electronic component 130, port 135, and male mating coupler 214, and top element 202 may comprise female mating coupler 218 for mounting top element 202 with bottom element 208 so as to join separable elements into divot tool body 105. Electronic component 130 may comprise flash memory device 225.

Figure 4:
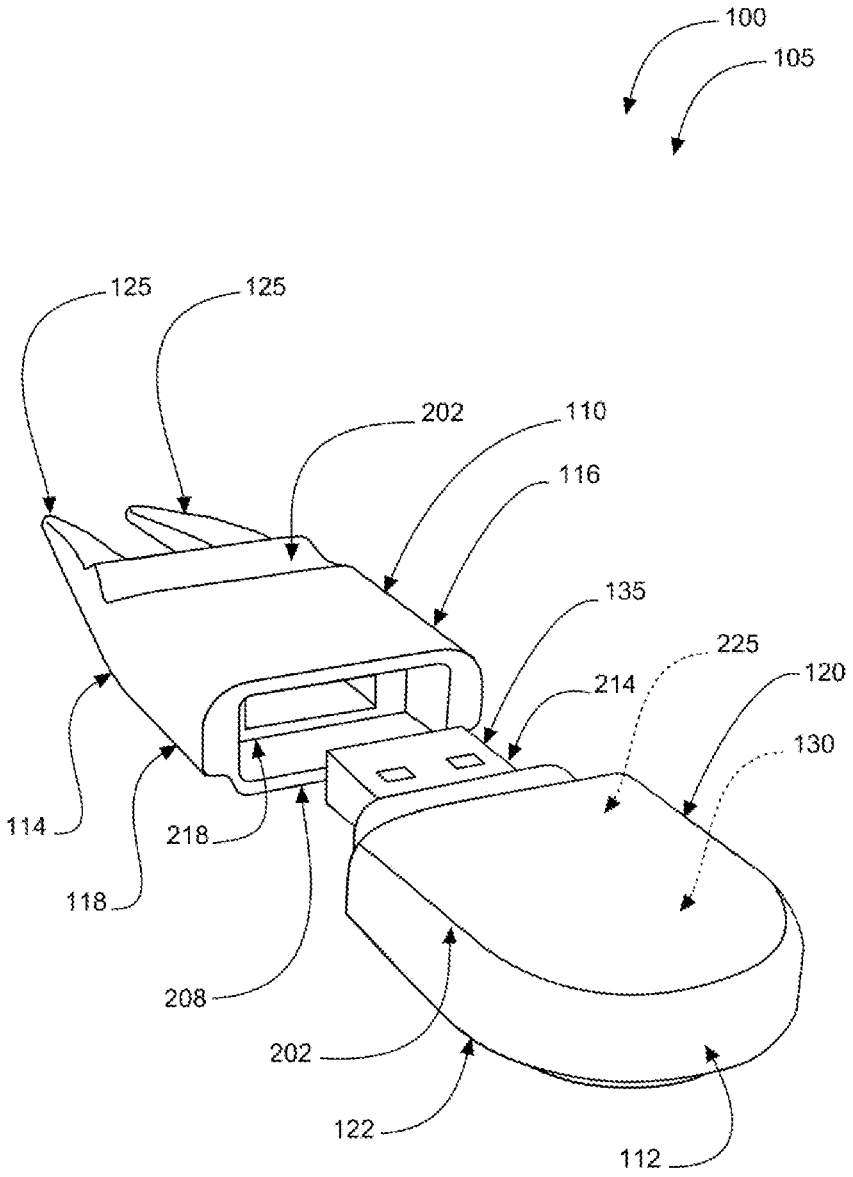
FIG. 4 is a rear angular perspective view depicting a flash memory device of the digital memory golf green repair tool system according to an embodiment of the present invention of FIGS. 1-3.

Referring now to FIG. 4 showing a rear angular perspective view depicting flash memory device 225 of digital memory golf green repair tool systems 100 according to an embodiment of the present invention of FIGS. 1-3. Port 135 of digital memory golf green repair tool systems 100 may compose a USB-compatible device. Port 135 may be useful for inserting the USB-compatible device into a USB port on an electronic device (such as a computer, smartphone, and the like). In such a manner, golfer-user 140 may transfer data from the electronic device onto the flash memory device 225 via port 135.

Figure 5:
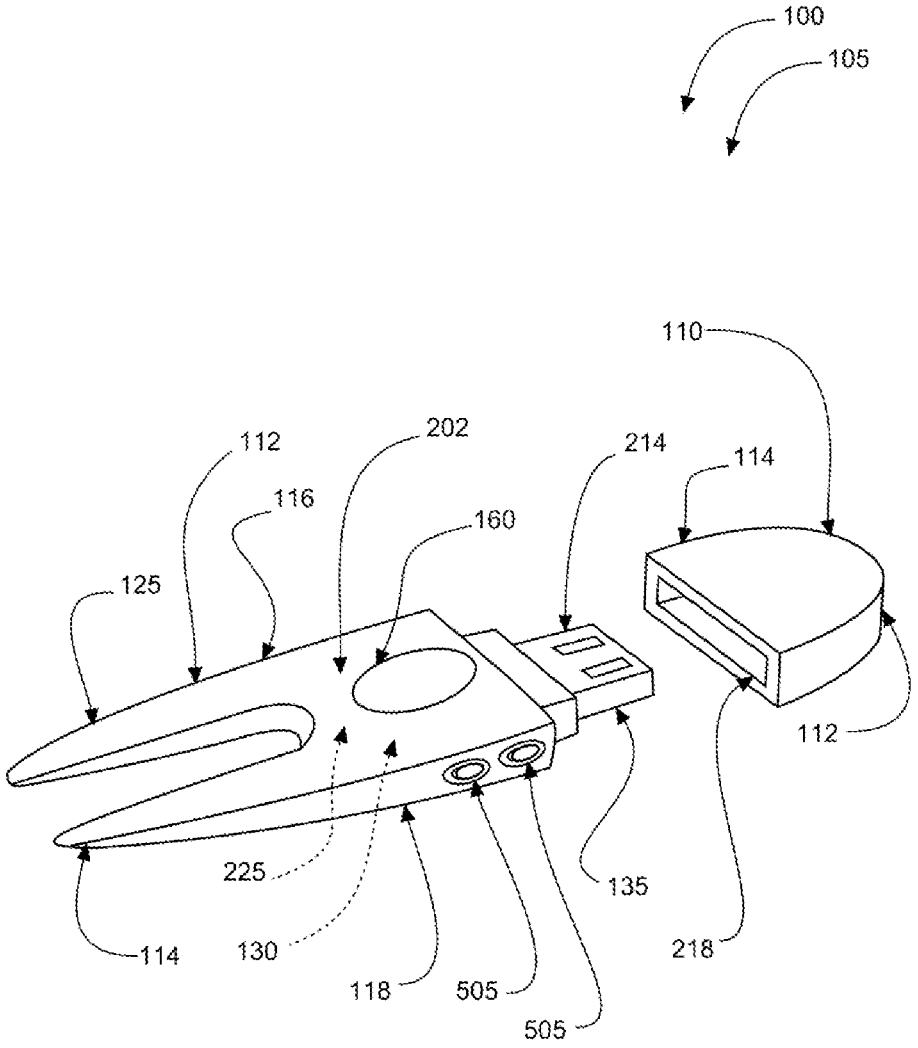
FIG. 5 is a perspective view illustrating the digital memory golf green repair tool system comprising at least one cable plug-in accessible on an outside of the divot tool body according to an embodiment of the present invention.

Referring now to FIG. 5 showing digital memory golf green repair tool systems 100 comprising cable plug-in 505 accessible on an outside of divot tool body 105 according to an embodiment of the present invention. Cable plug-in 505 may be useful for communicating with a variety of external electronic devices and mobile devices having alternative plug-in methods to USB. This port may also be used to charge the on-board power source, preferably a rechargeable battery. Alternatively, a micro-USB or other port known in the art, may be used for re-charging on-board power battery.

Figure 6A:
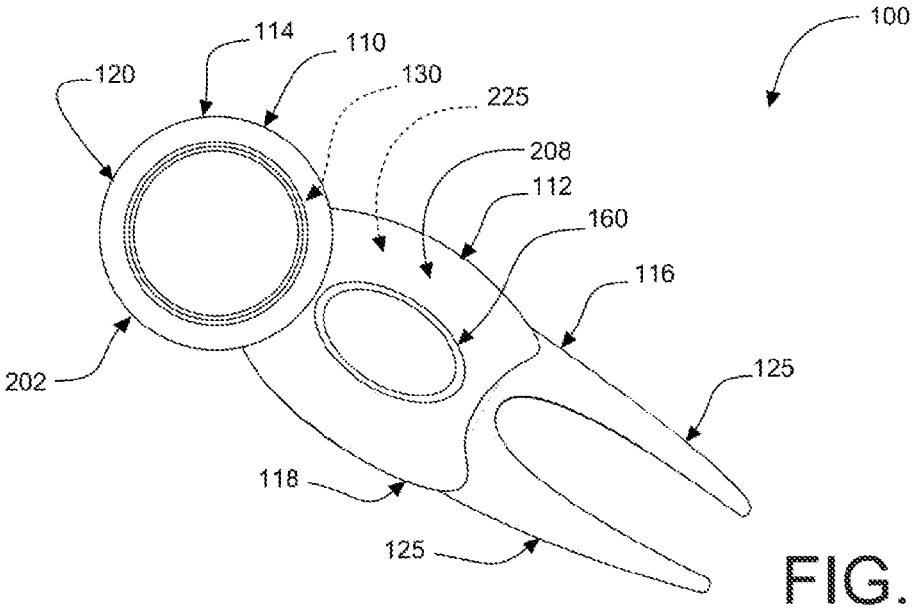
FIG. 6A is a perspective view illustrating the digital memory golf green repair tool system comprising the divot tool body having a ball marker according to an embodiment of the present invention.
Figure 6B:
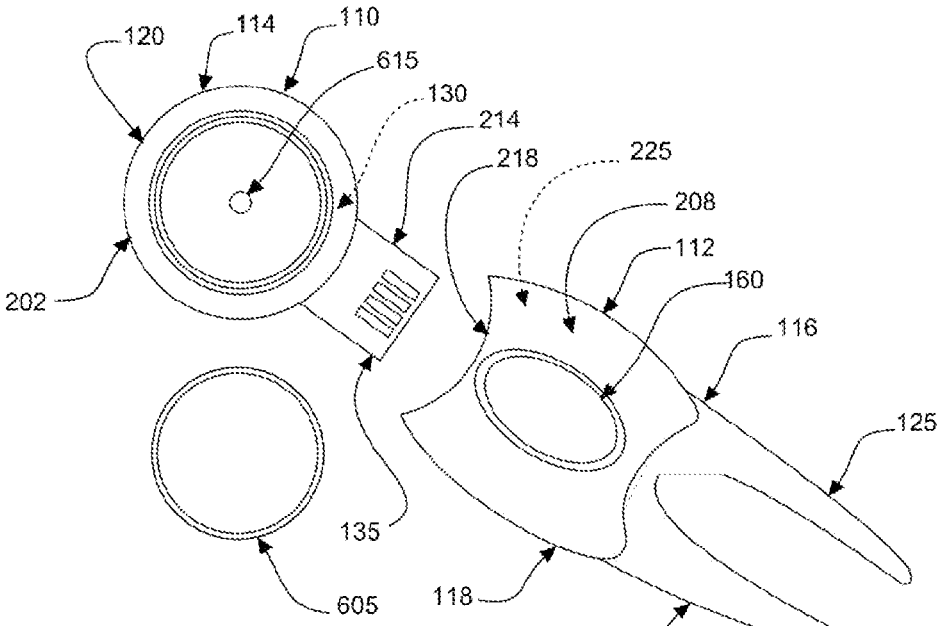
FIG. 6B is a perspective view illustrating the ball marker having a magnetic component for detachment and re-attachment of the ball marker according to an embodiment of the present invention of FIG. 6A.

Referring now to FIGS. 6A and 6B showing digital memory golf green repair tool systems 100 comprising divot tool body 105 having ball marker 605 according to an embodiment of the present invention. Digital memory golf green repair tool systems 100 may comprise thumb-sized hollow indentation 160 on handle 110 front 120, and ball marker 605 coupled to handle 110 front 120. Thumb-size hollow indentation 160 on handle 110 may provide golfer 140 with an ergonomic handling means for manipulating divot tool body during an 'in-use' condition. Ball marker 605 may be useful for placing on a putting green surface to mark the location of a golf ball of golfer 140 during play.

Referring specifically to FIG. 6B showing ball marker 605 having magnetic component 615 for detachment and re-attachment of ball marker 605 according to an embodiment of the present invention of FIG. 6A. Ball marker 605 of digital memory golf green repair tool systems 100 may comprise magnetic component 615 for mating with a complementary magnetic component housed within divot tool body 105. The magnet may be mounted on the interior of the tool body cavity for mating with a magnetic component/aspect of marker. The mounted magnet should be shielded to protect the on-board electronic components.

Figure 7A:
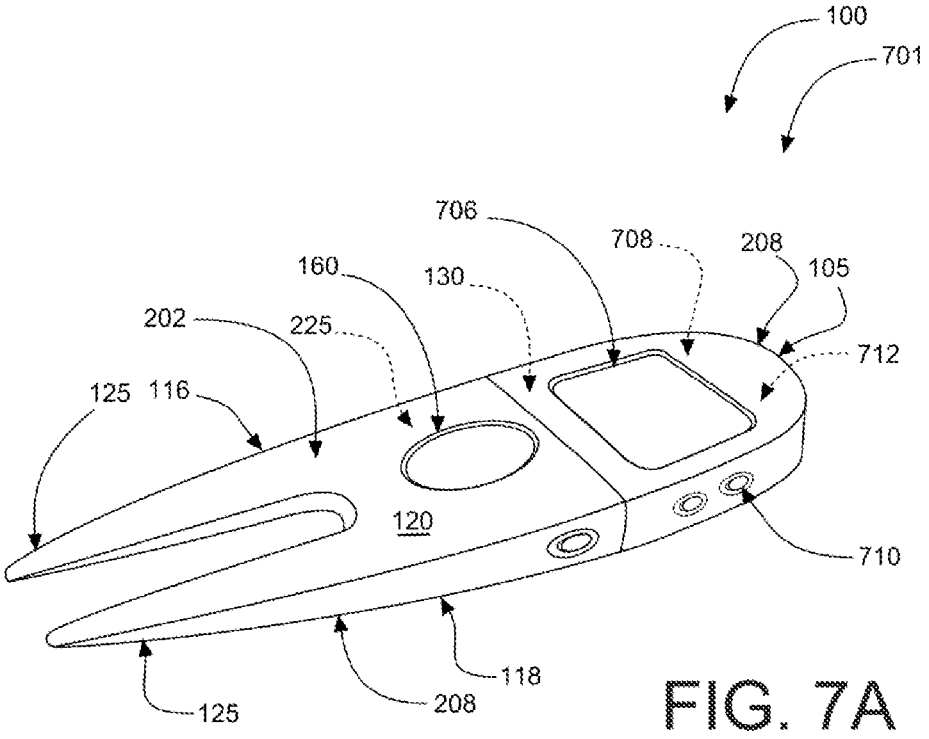
FIG. 7A is a perspective view illustrating the digital memory golf green repair tool system comprising a display screen located on a front of the divot tool body according to an embodiment of the present invention.
Figure 7B:
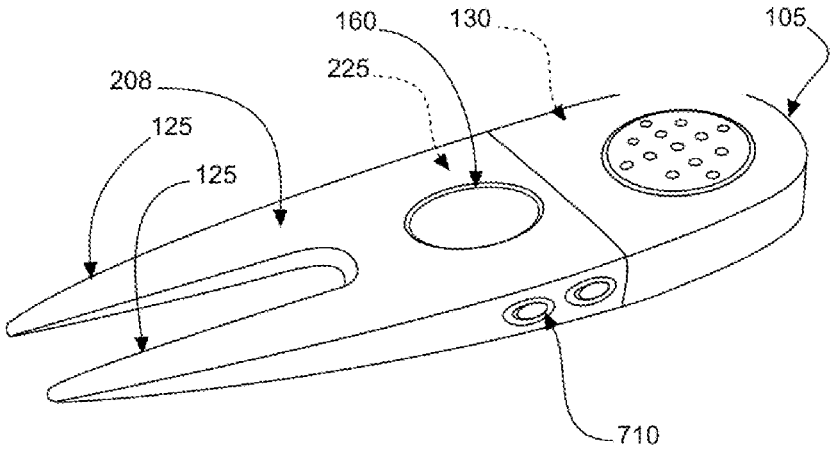
FIG. 7B is a perspective view illustrating the digital memory golf green repair tool system comprising a micro-speaker located on a back of the divot tool body according to an embodiment of the present invention of FIG. 7A.

Referring now to FIGS. 7A and 7B showing a perspective view illustrating digital memory golf green repair tool systems 100 comprising LCD display screen 706 located on a front of divot tool body 105 according to an embodiment of the present invention. As shown, electronic component 130 may comprise digital golf stroke counter assembly 701. In a preferred embodiment, digital golf stroke counter assembly 701 may comprise LCD display screen 706, microprocessor 708, a plurality of control buttons 710, and power source 712 for powering digital golf stroke counter assembly 701. Counter-microprocessor may be in communication with plurality of control buttons 710 and LCD display screen 706, and digital golf stroke counter assembly 701 may be structured and arranged to enable golfer 140 to track golf strokes while playing hole of golf. Counter-microprocessor of digital golf stroke counter assembly 701 may be able to write and read data file to flash memory device 225.

Referring specifically to FIG. 7B showing a perspective view illustrating digital memory golf green repair tool systems 100 comprising micro-speaker 820 located on a back of divot tool body 105 according to an embodiment of the present invention of FIG. 7A. Electronic component 130 may comprise audio component 814. As shown, audio component 816 may comprise micro-speaker 820 located on divot tool body 105. Audio component 816 may be structured and arranged to play audio file stored on flash memory device 225.

The device may also include an on-board microphone (not shown) to receive and store audio messages and files to allow for user input. A function button would allow for recording and stopping. Preferably, user would also be able to toggle through functions, and within function toggle through separate audio files. Foreseeably, the device could be used for audio journaling, or instruction. In this instance, it is preferred that the device contain an audio playback function through on-board speakers. As an alternative, the device can store unique audio files and later extract them from the digital audio by means of the USB or micro-USB port.

Figure 8:
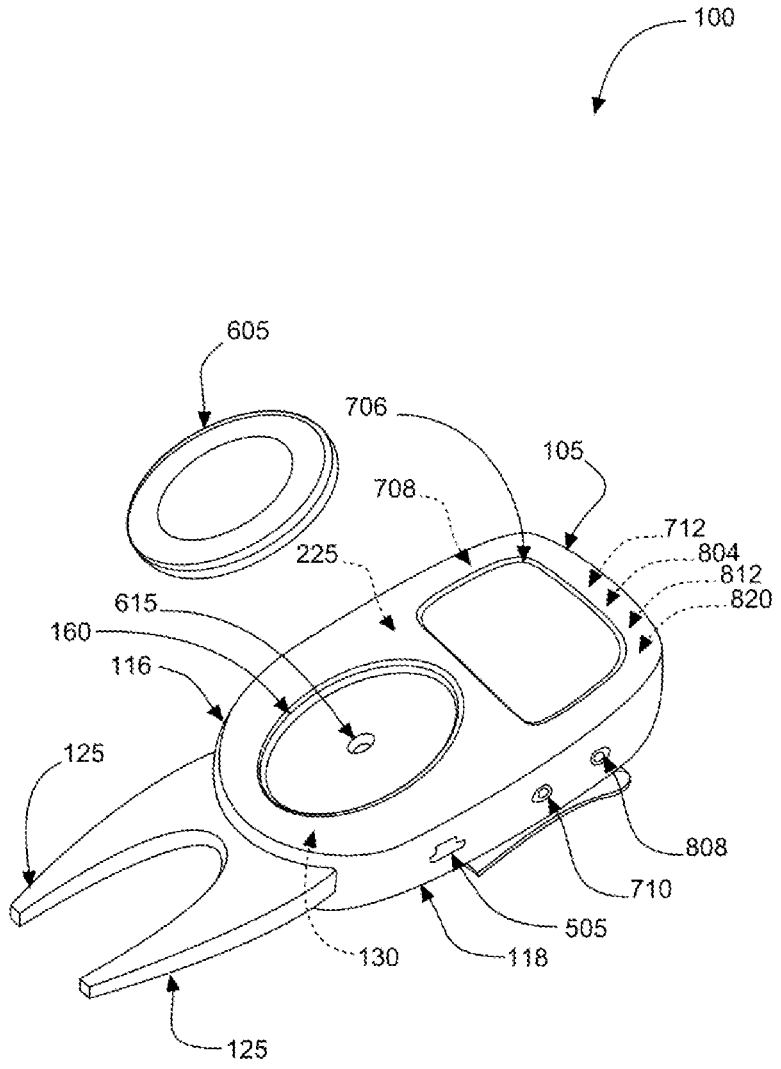
FIG. 8 is a perspective view illustrating the digital memory golf green repair tool system comprising a digital golf stroke counter assembly integrated into the divot tool body and also comprising a belt clip according to another embodiment of the present invention.

Referring now to FIG. 8 showing a perspective view illustrating digital memory golf green repair tool systems 100 comprising digital golf stroke counter assembly 701 integrated into divot tool body 105 according to another embodiment of the present invention. Electronic component 130 of digital memory golf green repair tool systems 100 may comprise GPS chip 804 for tracking a relative location of digital memory golf green repair tool systems 100 to golf-course-related point of interest 904. Digital memory golf green repair tool systems 100 may further comprise GPS switch 808 located on divot tool body 105 for enabling golfer 140 to activate or deactivate GPS chip 804. Divot tool body 105 may comprise belt clip 825 for removable attachment to a belt loop of user 902.

Other additions to the electronic components may include an on-board pedometer. In this instance, the action buttons would allow for reset, setting pedometer and causing display of pedometer results on LED screen. For the pedometer to work, the device would be clipped, or attached to the golfer user at some point where it may function, such as along a wrist, calf, on a shoe, etc.

In continuing to refer to FIG. 8, divot tool body 105 may comprise belt clip 825. Belt clip 825 may be useful for attaching divot tool body 105 to a belt loop of golfer 140. In such as manner, golfer 140 may be able to freely swing his or her golf club such that digital memory golf green repair tool system 100 does not interfere with freedom of swing of golfer 140.

Figure 9:
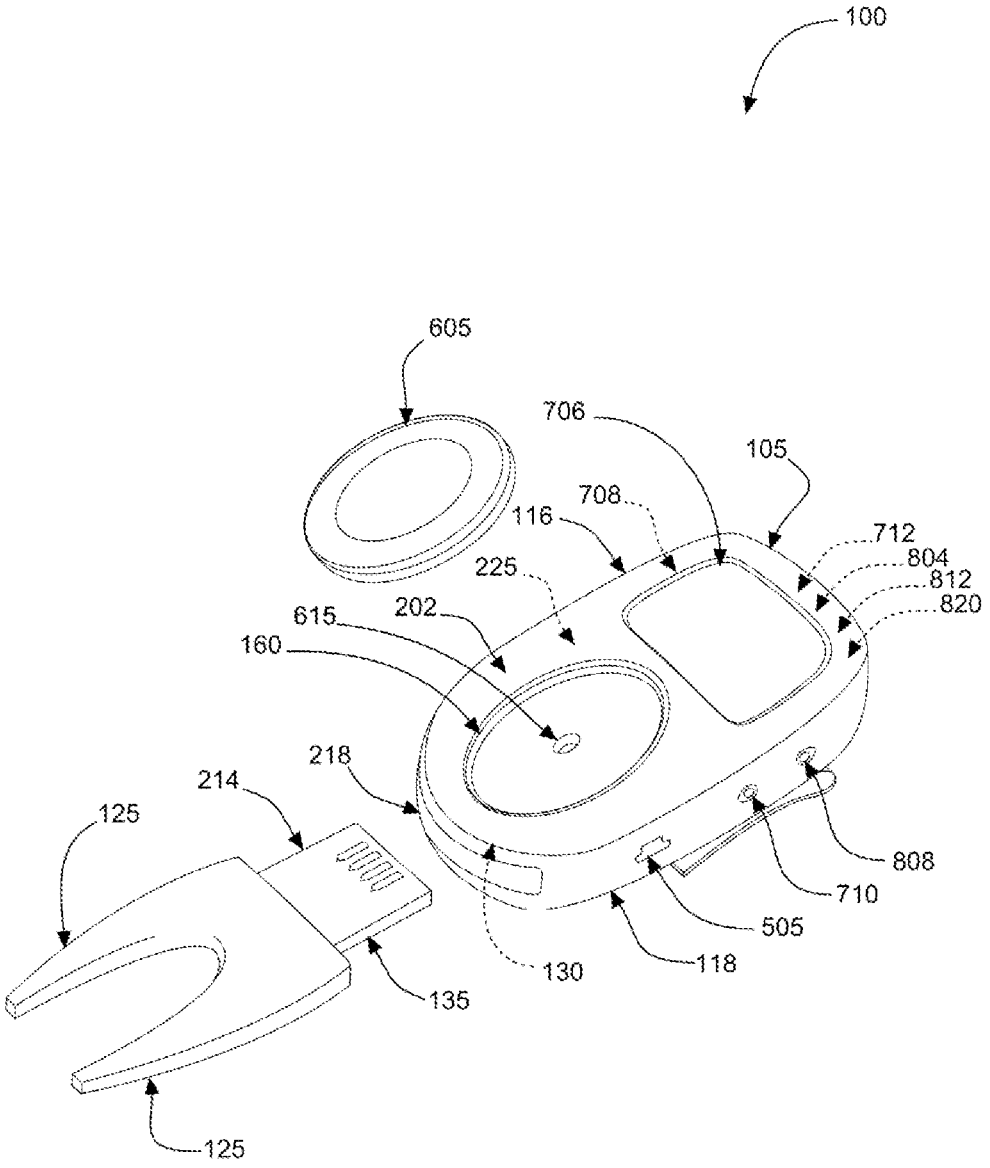
FIG. 9 is a perspective exploded view showing the ball marker and the flash memory device detachable from the divot tool body according to an embodiment of the present invention of FIG. 8.

In referring now to FIG. 9 showing a perspective exploded view showing ball marker 605 and flash memory device 225 detachable from divot tool body 105 according to an embodiment of the present invention of FIG. 8. Electronic component 130 may comprise RFID device 812, RFID device 812 structured and arranged to transmit and receive radio-frequency identification between GPS chip 804 and golf-course-related point of interest 904. Memory, such as flash, or components may be located/embedded on either location, together or separately. For instance, in the removable end, or in the tine portion. When the memory is not hard-wired to the other electronic components, as in where the cap must be placed for the connection of memory to device components, a complimentary mating portion will allow for the on-board electronic to access the memory. In most embodiments, it is preferable to include the memory with the other on-board components to allow for various functionality. When size is paramount, working towards a smaller embodiment of the invention, it may become necessary to detach the memory and store it on a piece apart from other components.

Figure 10:
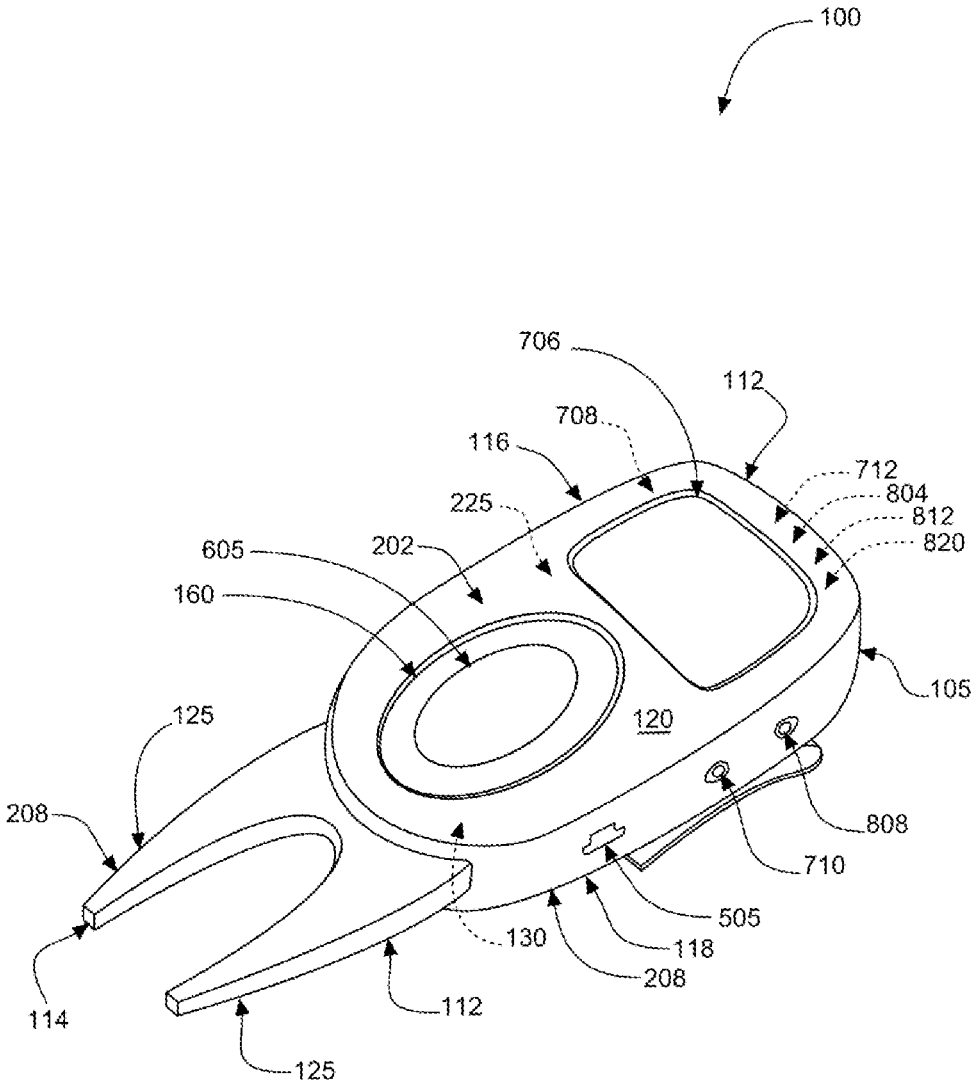
FIG. 10 is a perspective view illustrating the digital memory golf green repair tool system comprising a GPS chip and a RFID device integrated into the electronic component of the divot tool body according to an embodiment of the present invention of FIGS. 8 and 9.

In referring now to FIG. 10 showing a perspective view illustrating digital memory golf green repair tool systems 100 comprising GPS chip 804 and RFID device 812 integrated into electronic component 130 of divot tool body 105 according to an embodiment of the present invention of FIGS. 8 and 9.

Figure 11:
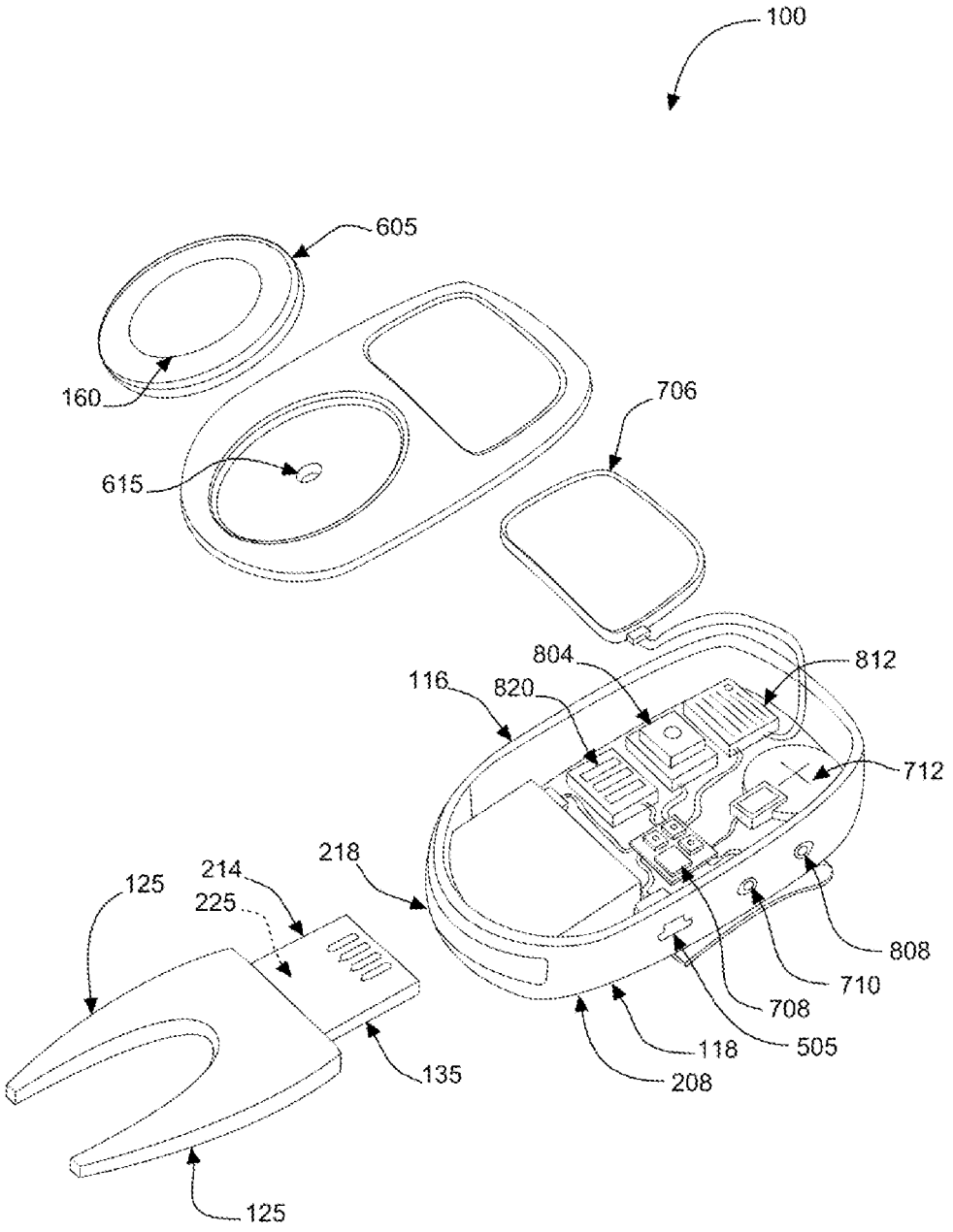
FIG. 11 is a first-exploded view illustrating various components of the digital golf stroke counter assembly of the digital memory golf green repair tool system according to an embodiment of the present invention.
Figure 12:
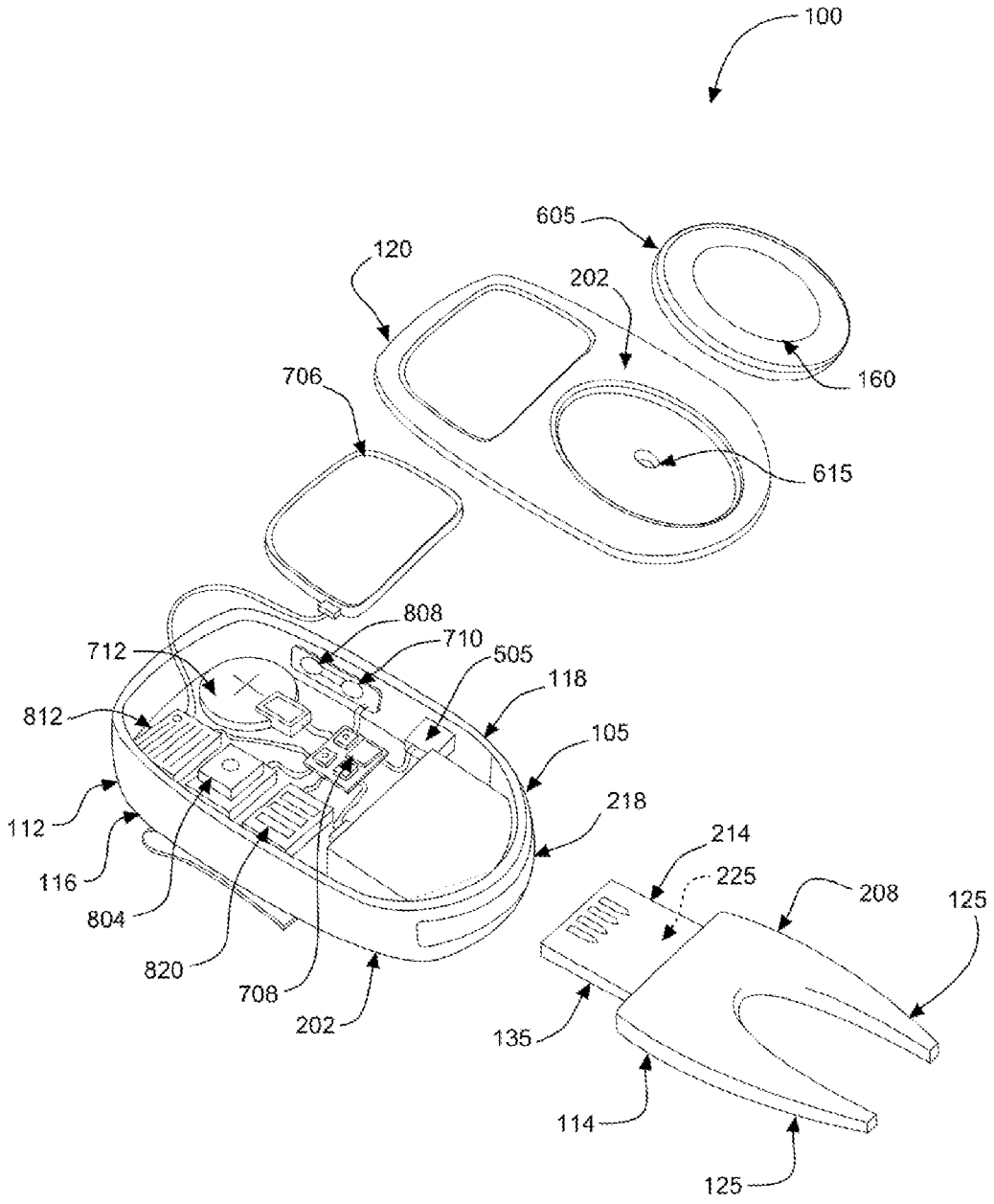
FIG. 12 is a second-exploded view illustrating various components of the digital golf stroke counter assembly of the digital memory golf green repair tool system according to an embodiment of the present invention of FIG. 11.

In referring now to FIGS. 11 and 12 showing a first-exploded view and a second-exploded view respectively illustrating components of digital golf stroke counter assembly 701 of digital memory golf green repair tool systems 100 according to an embodiment of the present invention of FIGS. 8-10. As shown, counter-microprocessor may be in communication with plurality of control buttons 710 and LCD display screen 706, and digital golf stroke counter assembly 701 via a plurality of circuitry cables. Further, RFID device 812 and GPS chip 804 may be in communication with power source 712 of digital golf stroke counter assembly 701 for providing operating power thereto.

Golf green repair tool systems 100 may be sold as a kit comprising the following parts: at least one divot tool body 105 comprising digital golf stroke counter assembly 701; and at least one set of user instructions. The kit has instructions such that functional relationships are detailed in relation to the structure of the invention (such that the invention can be used, maintained, or the like in a preferred manner). Digital memory golf green repair tool systems 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 13:
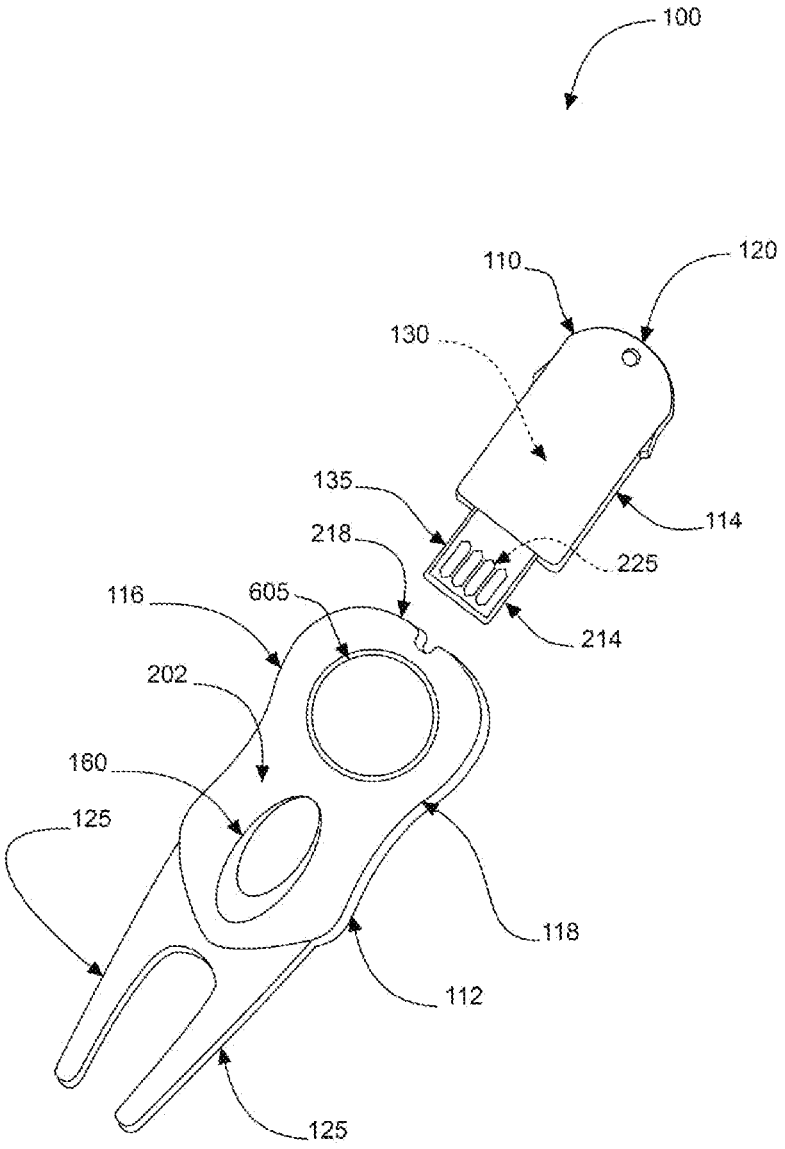
FIG. 13 demonstrates another embodiment of the present invention including a top-end associated data port.

As shown in FIG. 13, data port 135, preferably USB, may be associated with the top end of the present invention. In this embodiment, the data port and preferably the memory component are housed in the top portion of the tool. Tool system 100 includes front end 120, right side 116, left sides 118, bottom end 114. Top element 202 may be shown to include tines 125. In the alternative, handle 110 may be referred to as a top end. Handle 110 includes hole 117 for attachment of a manual device, such as a string, rope, lanyard, key ring, etc. to allow for easier use and manipulation of handle 110 to remove from top end 112/top element 202. Conversely, these items may be referred to as bottom element 112 and bottom end 202. Male mating coupler 214 may be positioned on handle 110 with port 135 and requisite memory device 225 within handle 110. A ball marker 605 may be attached to top end or bottom end, depending on preference of user. When attached on top element 202, as shown, any attachment device may be suitable. It is preferred that in such embodiment, no further electronics are included on top element 202 and all electronic components, i.e. memory system and port, would be on bottom end 114. Again, top and bottom in this embodiment may be reversed for understanding of the claimed invention. An indentation 160 and tines 125 may be included.

When assembled (not shown) male coupler 135 may mate with female port 218 to form a closed system to protect sensitive ports. The purpose of this embodiment is to provide for a streamlined tool system with ease of access to on-board memory. In addition, electronic components in system 100 are housed on an end that is narrow and accessible to be taken apart from the total tool system and plugged into a standard computer port. The low/thin/narrow profile, along with manipulation handle and hole, make use of the device with most computer systems more manageable on a practical basis when other nearby ports on such a computer device are in use. In alternative embodiment (not shown) the top and bottom (handle and tine section) may be attached to one another at one or more (preferably two) articulable swivel joints, with a side panel displaced to allow for movement of any extending parts (i.e. male port), as known in the art. The user would then bend/open the tool providing access to the electronic port.

Figure 14:
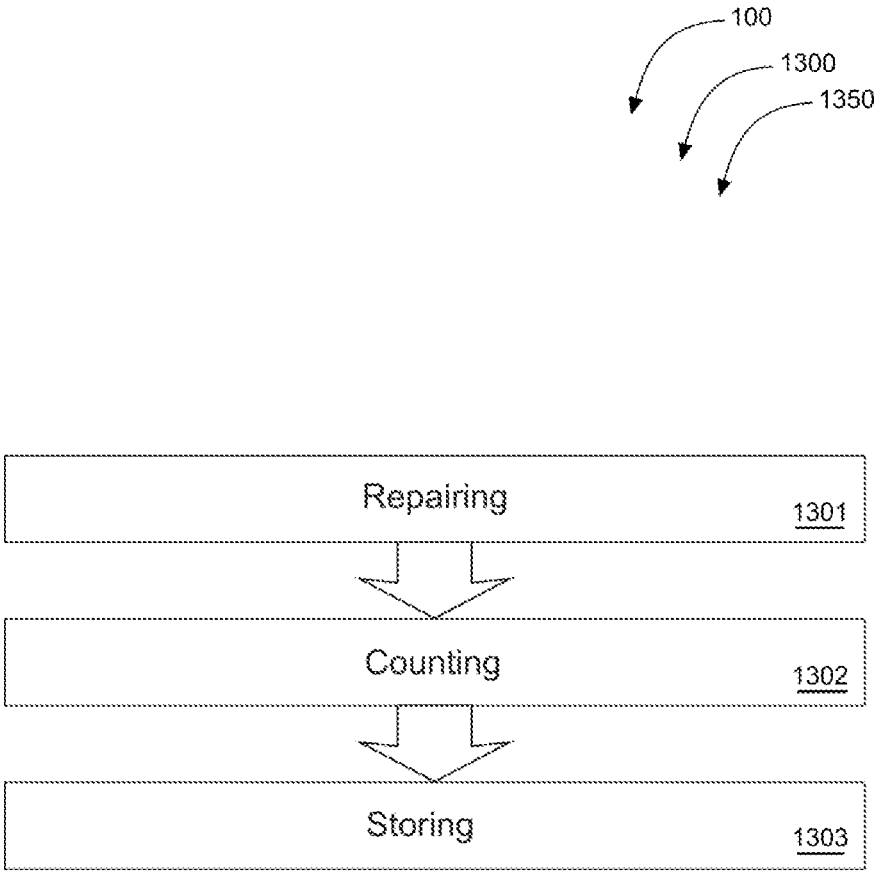
FIG. 14 is a flowchart illustrating a method of use for the digital memory golf green repair tool system according to an embodiment of the present invention of FIGS. 1-12.

Referring now to FIG. 14 showing flowchart 1350 illustrating method of use 1300 for digital memory golf green repair tool systems 100 according to an embodiment of the present invention of FIGS. 1-13. As shown, method of use may comprise the following steps: step one 1301, repairing a golf green surface via tines 125 of divot tool body 105; step two 1302, counting golf stroke(s) via digital golf stroke counter assembly 701; and step three 1303, storing at least one data file on flash memory device 225 for use with USB-compatible electronic device.

I claim:

1. A golf green repair tool system comprising:

a divot tool body having at least two separable sections, a top section and a bottom section, whereby said top section and said bottom section are coupled together via USB port;

said top section comprising:

at least two tines adapted to repair a golf green surface;

a cavity adapted to provide for housing a USB male port; and a top section outer surface comprising a face surface, said face surface comprising an indentation adapted for a thumb; and said bottom section comprising:

a fixed USB male port adapted to mate with said top section cavity;

a bottom section outer surface face for adjacently mating with said top section face surface when top section and bottom section are mated, said bottom section outer surface face comprising a removable ball marker;

an electronics package; and a magnet adapted for magnetically mating with said removable ball marker; and wherein said magnet is shielded for protection of an the electronics package.

2. The golf green repair tool system of claim 1, wherein said electronics package comprises:

a digital memory device coupled to said USB male port.

3. The golf green repair tool system of claim 2, wherein said electronics package comprises:

a microprocessor in communication with said digital memory device; and a rechargeable battery coupled to said microprocessor.

4. The golf green repair tool system of claim 3, further comprising at least a second port positioned on a side adjacent to said bottom section outer surface face, said port adapted for providing power to said rechargeable battery and communicably coupled with said microprocessor so as to allow information flow through said second port to load onto said digital memory device.

5. The golf green repair tool system of claim 4, further comprising at least a third port positioned on said side adjacent next to said at least second port.

6. The golf green repair tool system of claim 3, further comprising at least one control button in communication with said microprocessor, said at least one control button positioned on said side adjacent next to said at least second port.

7. The golf green repair tool system of claim 3, wherein said digital memory device comprises a pre-loaded data file.

8. The golf green repair tool system of claim 1, wherein said electronics package comprises an audio component.

9. The golf green repair tool system of claim 8, wherein said magnet is mounted on the interior of the tool body cavity.

10. The golf green repair tool system of claim 1, wherein said electronics package comprises an RFID antenna.

11. A golf green repair tool system comprising a body with at least a first section and at least a second section, said at least first section and said second section being separable; said system further comprising:

at least two tines emanating from an end of said body;

a digital memory system; and a USB male port electronically coupled to said digital memory system, said USB male port positioned opposite said at least two tines, said USB male port positioned on either of said first or second sections;

a cavity for housing said USB male port on the other of said either of said first or second sections, said cavity comprising a shield wall to protect electronic components;

a front surface, said front surface comprising a separable ball marker, said ball marker being magnetically mated to a magnet embedded in said front surface, wherein said magnet is positioned adjacent to said cavity shield wall.

12. The golf green repair tool system of claim 11 further comprising a display screen on said front surface.

13. The golf green repair tool system of claim 11 further comprising an outer side wall adjacent to said front surface, said side wall comprising at least one control button.

14. The golf green repair tool system of claim 13, said side wall further comprising a second port.

15. The golf green repair tool system of claim 11, further comprising a USB female port for mating with said male port to provide for data transfer between said digital memory system and said USB female port.

16. The golf green repair tool system of claim 15 further comprising a second port adapted to provide communication between said female USB port and an external component.

17. The golf green repair tool system of claim 16 wherein said second port comprises a micro-USB port.

18. The golf green repair tool system of claim 11, wherein said electronics components consist of said USB port coupled with said digital memory system.

19. The golf green repair tool system of claim 18, wherein said digital memory system comprises a flash memory device.

* * * * *

UNITED STATES PATENT AND TRADEMARK OFFICE

CERTIFICATE OF CORRECTION

PATENT NO. : 9,168,440 B1
APPLICATION NO. : 14/534165
DATED : October 27, 2015
INVENTOR(S) : Dean Paavola It is certified that error appears in the above-identified patent and that said Letters Patent is hereby corrected as shown below:

On the title page item [72] should read "Dean Paavola".

Signed and Sealed this
Nineteenth Day of April, 2016

Michelle K. Lee

Michelle K. Lee
*Director of the United States Patent and Trademark Office*